United States Patent [19]

Kravetz et al.

[11] 4,086,175

[45] Apr. 25, 1978

[54] ACTIVATED BLEACHING PROCESS AND COMPOSITIONS THEREFOR

[75] Inventors: Louis N. Kravetz; Hans E. Kubitschek, both of Houston, Tex.

[73] Assignee: Shell Oil Company, Houston, Tex.

[21] Appl. No.: 743,729

[22] Filed: Nov. 22, 1976

Related U.S. Application Data

[63] Continuation-in-part of Ser. No. 656,456, Feb. 9, 1976, abandoned.

[51] Int. Cl.[2] ..... C11D 7/56

[52] U.S. Cl. ..... 252/99; 252/95; 252/102; 252/186; 8/111; 423/272; 423/273; 427/212

[58] Field of Search ..... 252/99, 94, 102, 186; 8/111; 423/272, 273; 427/212, 213, 220

[56] References Cited

U.S. PATENT DOCUMENTS

| | | | |
|---|---|---|---|
| 3,494,786 | 2/1970 | Nielson | 252/95 X |
| 3,756,774 | 9/1973 | Kirner | 252/99 X |

*Primary Examiner*—Mayer Weinblatt

[57] ABSTRACT

A process for the activation of peroxide-based bleaches comprises conjointly incorporating into an aqueous medium a peroxide-based bleach, sufficient buffering agent to maintain the aqueous medium under alkaline conditions, cyanamide or a metal cyanamide as a peroxide activator, and magnesium, which acts in conjunction with cyanamide or metal cyanamide to further activate the peroxide-based bleach. Stable concentrated liquid or solid peroxide-based bleach compositions containing cyanamide or a metal cyanamide activator and a magnesium compound are also disclosed.

29 Claims, No Drawings

ACTIVATED BLEACHING PROCESS AND COMPOSITIONS THEREFOR

CROSS-REFERENCE TO RELATED APPLICATION

This application is a continuation-in-part of U.S. Ser. No. 656,456, filed Feb. 9, 1976 now abandoned and is related to U.S. Ser. Nos. 656,464 (now issued as U.S. Pat. No. 4,025,453) and 656,457, both filed Feb. 9, 1976.

BACKGROUND OF THE INVENTION

1. Field of the Invention

The present invention relates to an improved process for activating peroxide-based bleaches. In addition, it relates to concentrated bleaching compositions which alone or in combination with other ingredients can be added to an aqueous medium to effect the bleaching of fibrous materials and other bleachable substances over a wide range of temperatures.

2. Description of the Prior Art

Peroxide-based bleaches, such as hydrogen peroxide and perborates, are well known in the art and have been used for a number of years for bleaching textiles, and more recently, in home laundering applications for the bleaching of fabrics which cannot be safely bleached with chlorine-based bleaches because of problems with fiber and color damage. However, for home laundering use such bleaching agents generally have the disadvantage, as compared to chlorine-based bleaches, that their bleaching effectiveness falls off rapidly as the temperature decreases. For example, peroxide-based bleaches ar relatively ineffective at 60°–160° F, which are typical temperatures for home laundering in the United States.

Considerable effort has been devoted over the years to improve the effectiveness of peroxide-based bleaches at lower temperatures. One approach involves catalytic activation with the use of transition metals which decompose hydrogen peroxide to more reactive moieties which accelerate bleaching at lower temperatures. These activators generally must be used in the presence of compounds having suitable sequestering properties to prevent useless decomposition of the hydrogen peroxide. U.S. Pat. No. 2,975,139 to Kauffman et al. and U.S. Pat. No. 3,156,654 to Konecny et al. are representative of this approach. However, despite its technical feasibility, catalytic activation has not found lasting commercial application because of the difficulty in controlling the activation phenomenon under practical conditions, and interference by other chemical substances commonly found in bleach/detergent compositions.

A different approach to activation involves the use of "organic activators" which react with hydrogen peroxide to form peracids, which are relatively strong bleaching agents. A great number of these so-called "organic activators" are described in the prior art and generally comprise compounds having one or more acyl groups. U.S. Pat. No. 2,898,181 to Dithmar et al., for example, discloses certain carboxylic acid amides as activators for perborate bleaching agents. U.S. Pat. No. 3,163,606 to Viveen et al. discloses a variety of diacylated nitrogen containing compounds as activators for active oxygen releasing bleaches. Among the compounds specifically disclosed in this patent are N,N-diacetylcyanamide and the N-diacyldicyanodiamides. U.S. Pat. No. 3,583,924 to Demangeon et al. discloses a four component cleaning composition including a mineral persalt, an organic activator therefore, a water soluble cupric salt and a copper complexing agent. N,N-diacetylcyanamide and the N-diacyldicyanodiamides are also among the activators for the persalts specifically disclosed in this patent. A later issued Dithmar et al. patent, U.S. Pat. No. 2,927,840, discloses that certain organic nitriles are likewise activators for peroxidic compounds. The patent teaches that the best results are obtained with organic nitriles containing a plurality of nitrile groups which are not separated too far from each other.

A further patent, U.S. Pat. No. 3,756,774 to Kirner, discloses that organic nitriles will react with hydrogen peroxide under acidic conditions to form stable peroxy carboximides which can be employed in the bleaching of cellulosic textile materials in place of alkaline hydrogen peroxide solutions stabilized with sodium silicate. Among the various organic nitriles disclosed as being suitable for this purpose are cyanamide and dicyanodiamide. Other patents directed to methods of stabilizing hydrogen peroxide bleach baths without the use of sodium silicate include U.S. Pat. No. 2,820,690 to Feldman and U.S. Pat. No. 3,437,599 to Helmick et al. The Feldman patent discloses the use of magnesium and calcium orthophosphate salts as stabilizers in place of sodium silicate, while the Helmick et al patent discloses the use of alkaline earth metal carbonates for this purpose.

Despite the extensive efforts devoted by those skilled in the art to finding suitable activators for peroxide-based bleaches, there is in the United States today little practical application of this technology.

There are a number of reasons for this. One is that organic activators generally must be used in equimolar proportions with the active oxygen releasing component of the bleach package. Since most organic activators are relatively expensive, this results in the activator contributing significantly to the cost of the bleach formulation, and in many cases makes the product prohibitively expensive relative to competitive hypochlorite bleaches. Also, many prior art organic activators are relatively toxic or have unpleasant odors which render them unsuitable for use in applications such as home laundering.

A further drawback of many known organic activators is that they are unstable in storage and, hence, are not suitable for use in commercial bleach products which are stored over extended periods of time in warehouses or on the supermarket shelf before consumer use.

Copending U.S. application Ser. Nos. 656,464 (now issued as U.S. Pat. No. 4,025,453) and 656,457, both filed Feb. 9, 1976, describe certain novel activators (cyanamide and metal cyanamides) for peroxide-based bleaches which when employed under alkaline conditions provide substantially improved bleaching action, even at relatively low temperatures, and which are relatively inexpensive and do not suffer from the drawbacks of many of the prior art activators. While cyanamide and metal cyanamides under alkaline conditions have proved to be highly effective activators for peroxide-based bleaches over a wide range of concentrations, temperatures, and in the presence of a variety of detergents, the present invention provides a process and compositions for even further enhancing the already outstanding bleaching effectiveness of cyanamide and metal cyanamide-activated systems to levels comparable to chlorine-based bleaches.

SUMMARY OF THE INVENTION

It has now been found that the unique effectiveness of cyanamide and metal cyanamides as activators for peroxide-based bleaches can be further enhanced by the use of magnesium in combination with the cyanamide-activated bleach composition. In addition, it has been found that still greater levels of bleaching can be attained, if in addition to magnesium, certain compounds commonly employed as detergent builders, are also present in the alkaline aqueous bleaching/washing medium. Thus, the present invention provides an improved peroxide-bleach activation process comprising conjointly incorporating into an aqueous medium effective amounts of (a) a peroxide-based bleach, (b) a peroxide-activating amount of cyanamide or metal cyanamide, (c) a magnesium compound and (d) a buffering agent to maintain the aqueous medium under alkaline conditions. In a preferred embodiment of the invention detergent builders such as alkali metal phosphates, e.g., sodium tripolyphosphate (STPP) and trisodium phosphate (TSP), and alkali metal carbonates and silicates are additionally incorporated into the aqueous medium. Since certain of the aforementioned builders, peroxide-based bleaches and metal cyanamides typically provide alkalinity upon dissolution in an aqueous medium, it is to be understood that the buffering agent (d) can be supplied in whole or in part by the peroxide-based bleach (a), the metal cyanamide activator (b), the magnesium compound (c) or the builders which may be optionally employed. The present invention also provides stable concentrated solid (dry) or liquid peroxide-based bleach compositions which can be used for bleaching as such, or as a component of a soap or detergent formulation. Alternatively the peroxide-based bleach, cyanamide or metal cyanamide activator and magnesium compound may be added separately to an aqueous medium, with sufficient buffering agent to maintain the aqueous medium under alkaline conditions.

"Cyanamide-activated bleach or bleach composition" as used in this specification is intended to include either solid or liquid peroxide-based bleach compositions containing either cyanamide or a metal cyanamide as an activator therefor.

The effectiveness of magnesium in further enhancing (i.e., "boosting") the bleaching activity of cyanamide-activated bleaches appears unique in several respects. Firstly, similar results are not attained when magnesium compounds are employed in conjunction with many known peroxide bleach activators, and secondly, other Group II A metal salts and Group IA metal salts appear to have no appreciable effect on the bleaching activity of the cyanamide-activated system. In the case of transition metals and many other variable valence metals, significantly diminished bleaching performance is observed.

DETAILED DESCRIPTION OF THE INVENTION

Fundamental to this invention is the discovery that magnesium when employed in a cyanamide-activated peroxide-based bleach system, boosts the bleaching activity of the system to a substantial degree.

The mechanism by which magnesium acts to boost the bleaching effectiveness of cyanamide-activated peroxide-based bleaches is not known, nor is it known why the addition of certain detergent builders serves to further increase bleaching effectiveness of the overall system. It is known, however, that in order to obtain satisfactory activation employing the present magnesium cyanamide-activated bleach composition, it is generally necessary that the pH of the aqueous medium in which the bleaching or washing is accomplished (e.g., a washing machine in the case of home laundering) be maintained under alkaline conditions, e.g., at a pH of from 7.5 to about 13, or higher. Preferably the pH of the washing/bleaching medium will be from about 8.5 to about 11.5. Buffering of the bleaching/washing medium to the desired pH can be accomplished by adding an alkali and/or an alkaline buffering agent to the bleaching/washing medium prior to, concurrently with, or after the addition of the cyanamide/peroxide-based bleach. A convenient means of accomplishing buffering in the case of laundering applications is by the use of detergents, which commonly contain alkaline buffering agents. When metal cyanamides are employed as the activator, they contribute to the alkalinity of the aqueous bleaching medium, as do certain peroxide-based bleaches, e.g., perborates and percarbonates. Hence, normally lesser amounts or no additional alkaline buffering agents are required in bleach compositions containing metal cyanamides and the aforementioned peroxide-based bleaches.

The "peroxide-based bleach" component of the present composition can be hydrogen peroxide or any compound which releases hydrogen peroxide in aqueous solution. Such compounds include, for example, perborates, percarbonates, peracids, urea peroxide and ketone peroxides. Peroxy compounds of this type and their manner of preparation are well known in the art, and are described for example in Kirk-Othmer, Encyclopedia of Chemcial Technology, 2nd ed., Vol. 14, pp. 757–760. Of the various peroxide-based bleaches which can be suitably employed in accordance with the invention, hydrogen peroxide, perborates and percarbonates are preferred. Particularly preferred among the perborates are the sodium perborates, especially sodium perborate tetrahydrate ($NaBO_3.4H_2O$) because of its commercial availability. However, sodium perborate trihydrate ($NaBO_3.3H_2O$) and sodium perborate monohydrate ($NaBO_3.H_2O$) can also be suitably employed.

Cyanamide activators which can be suitably employed in the present compositions include cyanamide ($H_2NCN$) or any at least partially water soluble or water dispersible metal cyanamide. Preferred metal cyanamides include Group IA and Group IIA metal cyanamides such as calcium cyanamide (CaNCN), magnesium cyanamide (MgNCN), barium cyanamide (BaNCN), strontium cyanamide (SrNCN), disodium cyanamide ($Na_2NCN$), sodium acid cyanamide (NaHNCN), dipotassium cyanamide ($K_2NCN$), potassium acid cyanamide (KHNCN), dilithium cyanamide ($Li_2NCN$) lithium acid cyanamide (LiHNCN), and the like. Of the foregoing metal cyanamides, calcium cyanamide, disodium cyanamide and sodium acid cyanamide are preferred.

As previously discussed, the metal ion which has been found to enhance the bleaching action of cyanamide-activated peroxide based bleaches is magnesium, which appears to be unique in this regard.

Magnesium is normally incorporated into the cyanamide-activated peroxide-based system as a metal oxide or a metal salt, although any compounds which generate magnesium ions can be employed. A wide range of metal salts can be suitably employed to introduce magnesium into the bleach system including magnesium hydroxide, chloride, sulfate, nitrate, citrate and the like. Magnesium salts of ethylenediamine tetraacetic acid and its homologs are also very suitable. Because of its commercial availability, magnesium sulfate is an especially preferred magnesium salt.

Magnesium can be incorporated into the cyanamide-activated peroxide bleach system as part of the concentrated bleach formulation (either liquid or solid), or it may be added as a separate component to the aqueous bleaching/washing medium. Alternatively, magnesium can be provided by means of the metal cyanamide activator, which is a metal salt (e.g., magnesium cyanamide, generates magnesium ions upon dissolution in an aqueous medium, and thus can serve as both the activator and source of the magnesium ion).

The amount of peroxide-based bleach employed in accordance with the invention will vary widely depending on the material to be bleached, the extent of bleaching desired, and the bleaching conditions. In general, the amounts of peroxide-based bleach, calculated as hydrogen peroxide, in the concentrated bleach compositions will range from about 1 to about 35 percent by weight (%w) of the total composition, preferably from about 2 to about 15%w. Higher peroxide concentrations could be used but generally would not, because of the reactivity of highly concentrated peroxide solutions with organic material which could result in detonable mixtures. In cases where the peroxide-based bleach, cyanamide activator and magnesium are incorporated into a conventional detergent composition, lower concentrations of peroxide-based bleach (e.g., from 0.1 to 2% W, calculated as hydrogen peroxide) can be employed. However, in this case obviously lower levels of bleaching will be obtained than if the aforementioned concentrated activated peroxide-based bleach compositions are employed.

To effect bleaching, the activated peroxide-based bleach compositions of the invention are generally added to the aqueous medium in an amount that will result in 2 to 600 millimoles/liter (mmoles/l) of the peroxide-based bleach, calculated as hydrogen peroxide, being present in the aqueous medium. The precise peroxide-based bleach concentration selected will vary depending on the nature of the substance being bleached and the degree of bleaching desired.

For home and commercial laundry applications, the concentration of peroxide-based bleach in present compositions should suitably be such that the concentration of peroxide-based bleach, calculated as hydrogen peroxide, in the wash water will be on the order of 2 to 12 mmoles/l. As would be apparent to those skilled in the art, the foregoing concentrations could be varied if greater or lesser bleaching is desired.

Insofar as the proportions of cyanamide or metal cyanamide activator to the peroxide-based bleach are concerned, all that is required for purposes of the present invention is that a sufficient amount of cyanamide activator be present in the composition to activate the peroxide-based bleach upon addition to an alkaline aqueous bleaching/washing medium. Generally, the molar ratio of the cyanamide activator to the peroxide-based bleach will be on the order of from 1:20 to 20:1, with preferred ratios being from about 1:1 to about 1:10.

The concentration of magnesium in the present compositions can also vary over a relatively broad range. However, in general, the molar ratio of magnesium to the peroxide-based bleach will range from about 1:60 to about 25:1. Preferred magnesium to peroxide-based bleach molar ratios are from about 1:1 to about 1:10. For home laundry applications the concentration of magnesium in the wash water will generally range from about 0.1 to about 6 mmoles/l. Higher magnesium concentrations could be employed but generally would not because of the adverse effects such higher concentrations might have on detergency.

The present concentrated bleach compositions can be prepared in either liquid or solid form. If prepared in liquid form (e.g., an aqueous hydrogen peroxide solution containing cyanamide as an activator and magnesium sulfate to further enhance bleaching) it is important that pH of the bleach composition be maintained at a relatively low pH until the product is ready for use to avoid premature reaction and/or decomposition of the hydrogen peroxide and cyanamide (i.e., cyanamide undergoes various addition reactions under alkaline conditions, sometimes accompanied by a further increase in pH; hydrogen peroxide may decompose by either free radical or ionic reactions which in general proceed more rapidly at higher pH values). A stable (i.e., inactive or non-reactive) cyanamide activated peroxide-based bleach composition containing magnesium ions can be obtained by maintaining the pH of such composition at a value below 5, preferably at a pH of from 2 to 5, most preferably at a pH of about 4, until the composition is ready for use. The composition can readily be converted to a "active state" by adjusting the pH to an above 7.5 level at their time of use by addition of an alkali and/or alkaline buffering agent and/or alkaline detergent to the aqueous bleaching/washing medium, as previously discussed.

If desired, the hydrogen peroxide and cyanamide activator can be packaged in separate containers (the magnesium compound preferably being packaged with the hydrogen peroxide) and the two components added separately to the aqueous bleaching/washing medium just prior to use. In this manner premature reaction between cyanamide and hydrogen peroxide can also be avoided. However, even if packaged separately, it is still generally desirable that the pH of the respective hydrogen peroxide/metal salt and cyanamide solutions be maintained at a low pH until use in order to avoid decomposition of the peroxide and cyanamide, as previously discussed.

Concentrated solid bleach formulations in accordance with the invention wil generally comprise a solid peroxide-based bleach (e.g., sodium perborate monohydrate), a cyanamide activator therefore (e.g., solid cyanamide or a metal cyanamide such as sodium acid cyanamide), a magnesium salt (e.g., $MgSO_4$) and suitable alkaline buffering agents, fillers and/or desiccants. An advantage of such a concentrated solid bleach formulation over a concentrated liquid formulation is that the pH of the solid formulation need not be maintained at a low level while in storage because solid compositions are inherently stable so long as they are not contaminated with moisture. Such contamination can be avoided through the use of desiccants and/or by encapsulating the cyanamide activator and/or the solid peroxide-based bleach in accordance with well known procedures.

In general, any encapsulating technique which provides a covering for the cyanamide activator and/or peroxide-based bleach particles to prevent their coming into direct contact until they are added to the aqueous bleaching medium can be suitably employed in the practice of this invention. Thus, the function of the covering material (encapsulating agent) is to prevent premature reaction or decomposition of the cyanamide activator and peroxide-based bleach while in storge, yet effectively release the activator and/or peroxide-based bleach upon addition to the aqueous bleaching medium.

Suitable encapsulating agents include both water soluble and water dispersible substances such as stearic acid, polyethyleneglycols, condensation products of ethyleneoxide and propyleneoxide (e.g. alcohol ethoxylates, polyvinyl alcohol, carboxymethylcellulose, cetyl alcohol, fatty acid alkanolamides and the like). Encapsulation may be conveniently accomplished by dissolving the encapsulating agent in an volatile organic solvent and spraying the finely divided particles of cyanamide activator and/or peroxide activated bleach with the solution after which the sprayed particles are dried. Such a procedure is described, for example, in U.S. Pat. No. 3,163,606. Other suitable encapsulation techniques are described in U.K. Pat. No. 1,395,006.

The present compositions can be employed over a relatively wide range of temperatures, e.g., from about 45% up to the point of water (212° F). However, it can most advantageously be employed at temperatures of 60° to 160° F, which encompasses typical temperatures of home laundering in the United States. As previously stated, a substantial improvement in bleaching effectiveness is obtained by use of the present compositions as compared to the use of peroxide-based bleaches alone, or peroxide-based bleaches activated with many of the prior art activators.

The cyanamide-activated bleaching compositions of the present invention containing magnesium can be employed to bleach any of a wide variety of bleachable substances including textiles, wood and wood products, surfactants, leather, hair and any other substance commonly bleached with peroxide-based bleaches. The present compositions are especially suitable for use in home and commercial laundering applications, wherein unactivated peroxide-based bleaches are largely ineffectual because of the relatively short wash cycles and lower temperatures involved, particularly in the United States. The compositions of the invention are effective in bleaching stains from a wide variety of fabrics, including those manufactured from natural as well as synthetic fibers. They are particularly effective for washing cotton goods and goods produced from synthetic fibers, and are advantageous over chlorine-based bleaches in that they do not cause yellowing of fabrics even after repeated washings. In addition, the compositions of the present invention would be expected to cause considerably less loss in strength of fibers than do chlorine-based bleaches, and are also safer to use on colored materials.

The activated bleaching compositions of the invention may generally also be used for their germicidal properties in various applications, for example, as a disinfectant for use in the home, e.g., in kitchens, bathrooms, etc., for institutional use, for water treatment and the treatment of swimming pools, etc.

In the case of home or commercial laundering, the compositions of the present invention will normally be employed in conjunction with a soap or detergent, which may be provided as a part of the bleach/washing composition, or may be added separately to the wash liquor. In general, any commonly used soap may be employed for this purpose, for example, alkali metal salts of fatty acids, such as stearic and/or palmitic acids, or of rosin acids. Synthetic detergents which can be used with or without such soaps include the anionic, cationic, zwitterionic, ampholytic, non-ionic and semipolar organic surface-active agents. Typical anionic detergents which can be employed in the practice of the present invention include various sulfates and sulfonates, such as alkyl aryl sulfonates, alkyl sulfonates, sulfates of fatty acid-monoglycerides, olefin sulfonates, sulfonated fatty acids and esters, alkyl glyceryl ether sulfonates, fatty isethionates, fatty acid oxyethylamide sulfates, oleylmethyltauride, and the like, having aliphatic hydrocarbon chains of about 10 to about 20 carbon atoms, and alkyl sulfate, alkyl polyether sulfate and alkyl phenol polyether sulfate salts such as sodium lauryl sulfate, sodium alkyl phenol polyether sulfates and mixed secondary alkyl sulfate alkali metal salts of 8 to 18 carbon atoms per molecule. Examples of non-ionic surface active agents which can be used in the practice of the invention are the saponines, fatty alkanolamides, amine oxides and ethylene oxide condensation products with fatty acids, alcohols, polypropylene glycols, alkyl phenols, esters, and the like, especially those with alkyl chains of 8 to 20 carbon atoms and 3 to 20 glycol units per molecule. Examples of typically suitable cationic surface active agents include those based on diamines, e.g., N-aminoethyl stearyl amine and N-aminoethyl myristyl amine; amide-linked amines, e.g., N-aminoethyl-stearyl amide and N-aminoethyl-myristyl amide; quaternary ammonium compounds containing at least one long chain alkyl group attached to the nitrogen atom, e.g., ethyl-dimethyl-stearyl ammonium chloride and dimethyl-propyl-myristyl ammonium chloride; and the like.

Any of the builders or other additives conventionally employed in bleach or detergent products can be used in the bleaching compositions of the invention. These include, for example, alkaline materials such as alkali metal hydroxides, phosphates (including orthophosphates, tyipolyphosphates and pyrophosphates) carbonates, bicarbonates, citrates, polycarboxylates, borates and silicates, also alkanolamines and ammonia. Inert compounds such as alkali metal sulfates or chlorides can also be employed.

As previously mentioned, in an especially preferred embodiment of the invention, one or more alkali metal phosphates, carbonates or silicates are additionally incorporated into the aqueous bleaching/washing medium, to atain even greater bleaching enhancement as demonstrated by the data in Example 5.

Other additives which may optionally be incorporated in or used in conjunction with the instant compositions, include fabric softeners, germicides, fungicides, enzymes, anit-redeposition agents, flocculants, optical brighteners, colorants, perfumes, thickeners, stabilizers, suds builders or suds depressants, anticorrosion agents, fluorescent agents and the like.

The present invention and its benefits are further described in the following examples, which are intended only to be illustrative of the invention, and should not be construed as limiting.

EXAMPLE 1

The following exmperiments evidence the improved bleaching action obtainable by practice of the present invention. The general procedure employed in these tests was as follows:

Five hundred (500) ml of deionized water was added to a U.S. Testing, Inc. Terg-O-Tometer bath maintained at the temperatures indicated in Table I and the hardness level of the water adjusted to 150 ppm as $CaCO_3$ (Ca/Mg = 3/2 on a molar basis). The pH of the water in the bath was adjusted to the values shown in Table I by the addition of the detergent and NaOH as required, as the alkaline buffering agents. The peroxide-based bleach, cyanamide activator, magnesium compound and detergent were added to the wash water in the concentrations shown in Table I, and the water agitated to avoid localized concentrations of any one additive. Finally, eigth swatches, measuring 4 × 4 inches, of EMPA 115 cloth (a standard cotton bleach test cloth soiled with sulfur black dye) were introduced into the wash water and the agitator run for 10, 20, 30 or 60 minutes at 100 rpm. At the conclusion of each wash period, two swatches were removed and rinsed by squeezing under a tap. The test cloths were then dried and the reflectance values measured on a Gardner Reflectometer, Model UX-2, utilizing a G filter. The change that occurred as a result of the bleach/wash cycle was reported as the change in percent reflection value (ΔR), which equals the difference between the reflectance of the swatch after bleaching and the reflectance of the same swatch before bleaching. Thus the larger the ΔR value, the more effective the bleaching action.

The compositions tested and the results obtained are presented in Table I.

TABLE I

| Experiment No. | Bleach[a] mmoles/l | $H_2NCN$ mmoles/l | Magnesium[b] Sulfate mmoles/l | Detergent[c] g/l | pH Init. | pH Final | Temp ° F | ΔR Wash Cycle 10 mins. | 20 mins. | 30 mins. | 60 mins. |
|---|---|---|---|---|---|---|---|---|---|---|---|
| 1 | 8 | 0 | 0 | 1.5 | 9.8 | 9.5 | 185 | 4.3 | 7.5 | 9.7 | — |
| 2 | 8 | 8 | 0 | 1.5 | 9.2 | 8.9 | 185 | 26.4 | 31.9 | 33.6 | — |
| 3 | 8 | 8 | 8 | 1..5 | — | — | 185 | 36.1 | 43.2 | 47.1 | — |
| 4 | 8 | 0 | 0 | 1.5 | 9.7 | 9.6 | 120 | 0.8 | 1.5 | 1.9 | — |
| 5 | 8 | 8 | 0 | 1.5 | 9.3 | 8.8 | 120 | 18.1 | 26.0 | 30.3 | — |
| 6 | 8 | 8 | 4 | 1.5 | 9.1 | 8.5 | 120 | 21.1 | 31.2 | 36.8 | — |
| 7 | 8 | 8 | 8 | 1.5 | 9.0 | 8.5 | 120 | 19.3 | 30.0 | 36.2 | — |
| 8 | | | | | | | | | | | |
| 8 | 8 | 16 | 1.5 | 8.9 | 8.4 | 120 | 18.0 | 28.3 | 33.9 | — | |
| 9 | 8 | 0 | 0 | 1.5 | 9.3 | 8.8 | 45 | — | — | 0.8 | 0.5 |
| 10 | 8 | 8 | 0 | 1.5 | 8.9 | 8.7 | 45 | — | — | 3.7 | 7.2 |
| 11 | 8 | 8 | 1 | 1.5 | 8.9 | 8.6 | 45 | — | — | 3.2 | 7.1 |
| 12 | 8 | 8 | 0 | 1.5 | 9.8 | 9.7 | 45 | — | — | 5.7 | 9.1 |
| 13 | 8 | 8 | 1 | 1.5 | 9.3 | 9.1 | 45 | — | — | 6.6 | 10.6 |
| 14 | 8 | 8 | 8 | 1.5 | 9.7 | 9.4 | 45 | — | — | 6.4 | 12.2 |

[a]Hydrogen peroxide (introduced as a stabilized, commercial grade; 50% aqueous solution)
[b]Introduced as $MgSO_4 \cdot 7H_2O$.
[c]Tide containing 6.1% phosphorus (Tide, 6.1% P). Tide is a powdered detergent manufactured by Procter & Gamble Company.

The foregoing tests indicate that the compositions of the invention containing hydrogen peroxide, cyanamide and a magnesium compound in various proportions provide significantly enhanced bleaching action over a wide range of temperatures.

EXAMPLE 2

In this example a series of experiments was conducted with various magnesium salts and magnesium oxide as well as salts of other metals for comparison purposes. Unless otherwise noted the test procedure employed was the same as that used in Example 1. The compositions tested and results obtained are tabulated below.

TABLE II

| Experiment No. | Bleach[a] mmoles/l | Metal Salt or Oxide mmoles/l | Detergent[b] Compound | Detergent[b] mmoles/l | pH g/l | Temp Initial | Wash Cycle ° F | ΔR 10 mins. |
|---|---|---|---|---|---|---|---|---|
| 15 | 8.8 | 8.8 | — | — | 1.5 | 9.8 | 120 | 14 |
| 16 | 8.8 | 8.8 | MgO[c] | 10.5 | 1.5 | 9.8 | 120 | 22 |
| 17 | 8.8 | 8.8 | $MgCl_2 \cdot 6H_2O$ | 4.9 | 1.5 | 9.8 | 120 | 28 |
| 18 | 8.8 | 8.8 | $MgSO_4 \cdot 7H_2O$ | 3.3 | 1.5 | 9.8 | 120 | 23 |
| 19 | 8.8 | 8.8 | $Mg(NO_3)_2 \cdot 6H_2O$ | 3.9 | 1.5 | 9.8 | 120 | 26 |
| 20 | 8.8 | 8.8 | Al(CH hd 3COO)$_3$[d] | 7.1 | 1.5 | 9.8 | 120 | 11 |
| 21 | 8.8 | 8.8 | LiOH | 37.0 | 1.5 | 9.8 | 120 | 15 |
| 22 | 8.8 | 8.8 | RbCl | 8.3 | 1.5 | 9.8 | 120 | 16 |
| 23 | 8.8 | 8.8 | $NiCl_2 \cdot 6H_2O$ | 4.2 | 1.5 | 9.8 | 120 | 1.9 |
| 24 | 8.8 | 8.8 | $MnSO_4 \cdot H_2O$ | 6.0 | 1.5 | 9.8 | 120 | 0 |
| 25 | 8.8 | 8.8 | $CuCl_2 \cdot 2H_2O$ | 1.2 | 1.5 | 9.8 | 120 | −2.2 |
| 26 | 8.8 | 8.8 | $Fe(NO_3)_3 \cdot 9H_2O$ | 2.5 | 1.5 | 9.8 | 120 | 3.0 |
| 27 | 8.8 | 8.8 | $HgCl_2$ | 7.4 | 1.5 | 9.8 | 120 | 5.4 |
| 28 | 8.8 | 8.8 | $NH_4VO_3$ | 8.6 | 1.5 | 9.8 | 120 | 0.6 |
| 29 | 8.8 | 8.8 | $Ti(i\text{-}C_3H_7O)_4$ | 7.0 | 1.5 | 9.8 | 120 | 1.4 |
| 30 | 8.8 | 8.8 | $SnCl_2$ | 5.3 | 1.5 | 9.8 | 120 | 12.0 |

[a]Hydrogen peroxide (introduced as a stabilized commercial grade 50% aqueous solution, except as noted).
[b]Tide, 6.1%P.
[c]Added as $4MgCO_3 \cdot Mg(OH)_2 \cdot n\ H_2O$ (42.4% MgO).
[d]Added as $Al(OH)_2(CH_3COO) \cdot \frac{1}{2}H_3BO_3$.

The foregoing results indicate that various magnesium salts and oxides can be effectively employed in further increasing the bleaching effectiveness of cyanamide activated peroxide-based bleaches, and that bleach enhancement is not critically affected by the anion with which magnesium is introduced. The data further indicate that Group IA metals such as lithium or rubidium are not effective in enhancing the bleaching activity of the cyanamide/peroxide system, nor is aluminum acetate, a Group IIIA metal salt. The variable valence metals tested, except for tin which showed no appreciable effect, considerably depressed the bleaching action of the cyanamide/peroxide system.

EXAMPLE 3

In this example a series of experiments was conducted utilizing the test procedures outlined in Example 1, except as otherwise noted, to compare the bleaching effectiveness of several commercially available peroxide-based bleaches (identified in Table III) when used alone, to the same bleaches containing cyanamide as an activator or a combination of cyanamide with a magnesium salt. The commercial peroxide-based bleaches employed in these experiments are tabulated in Table IV.

TABLE III

| Product | Type | % $H_2O_2$[c] |
|---|---|---|
| Bleach A | Liquid[a] | 5.9 |
| Bleach B | Liquid[a] | 3.2 |
| Bleach C | Solid[b] | 4.9 |
| Bleach D | Solid[b] | 8.0 |
| Bleach E | Solid[b] | 7.5 |
| Bleach F | Solid[b] | 4.9 |

[a]Aqueous hydrogen peroxide.
[b]Contains sodium perborate which dissolves in wash water to form hydrogen peroxide.
[c]Determined by iodometric titration.

TABLE IV

| Experiment No. | Product[a] | Product Only % $H_2O_2$ Utilized[b] | ΔR | Product plus $H_2NCN$[c] % $H_2O_2$ Utilized[b] | ΔR | Product plus $H_2NCN$[c] % $H_2O_2$ Utilized[b] | plus Mg[d] ΔR |
|---|---|---|---|---|---|---|---|
| 31 | Bleach A | 0 | 3.1 | 95 | 17 | 73 | 26 |
| 32 | Bleach B | O | 3.2 | 90 | 17 | 71 | 24 |
| 33 | Bleach C | 0 | 3.5 | 89 | 14 | 65 | 12 |
| 34 | Bleach D | 0 | 4.1 | 91 | 8 | 76 | 19 |
| 35 | Bleach E | 0 | 2.5 | 94 | 11 | 78 | 19 |
| 36 | Bleach F | 0 | 2.4 | 83 | 11 | 77 | 23 |

[a]Added to wash water to provide initial $H_2O_2$ concentration of 8.8 mmoles/1. Washing conditions in addition to or other than those shown in Example 1: Detergent concentration 1.5 g/1 Tide, 6.1%P, temperature of all runs 120° F, wash cycle 10 mins, pH adjusted to 9.6–10.
[b]Determined by iodometric titration on 50–100 ml of wash liquor immediately (within one minute) after wash.
[c]$H_2HCN$ concentration 8.8 mmoles/1.
[d]Added as $MgSO_4 \cdot 7\ H_2O$ at 3.3 mmoles/1.

The foregoing test results indicate that while the commercial peroxide-based bleaches are virtually ineffective in bleaching the test cloth under the conditions shown, the addition of cyanamide as an activator, or a combination of cyanamide plus a magnesium compound, substantially improves their performance and results in more effective utilization of the hydrogen peroxide.

EXAMPLE 4

The effectiveness of magnesium in further enhancing the bleaching action of a solid cyanamide-activated peroxide bleach system was demonstrated in a series of experiments in which various amounts of magnesium salts were employed in conjunction with a sodium acid cyanamide activated peroxide-based bleach (sodium perborate monohydrate). The test procedure employed in this series of tests was the same as that of Example 1, except as noted. The compositions employed and the results of the tests are presented in the following table.

TABLE V

| Experiment No. | Bleach SPB-1[a] mmoles/l | NaHNCN mmoles/l | Magnesium Sulfate[b] mmoles/l | Detergent[c] Type | Detergent[c] g/l | pH Initial | pH Final | Temp °F | ΔR Wash Cycle 10 mins | 20 mins | 30 mins | 60 mins |
|---|---|---|---|---|---|---|---|---|---|---|---|---|
| 37 | 8 | 8 | 0 | — | 0 | 10.7 | — | 118 | 26 | 29 | 32 | 34 |
| 38 | 8 | 8 | 0 | A | 1.5 | 10.4 | 10.0 | 118 | 28 | 35 | 38 | 42 |
| 39 | 8 | 8 | 4 | A | 1.5 | 9.9 | 9.5 | 118 | 30 | 38 | 42 | 45 |
| 40 | 8 | 8 | 8 | A | 1.5 | 9.7 | 9.3 | 118 | 32 | 38 | 41 | 45 |
| 41 | 8 | 8 | 0 | B | 1.5 | 10.8 | — | 118 | 13 | 15 | 17 | 19 |
| 42 | 8 | 8 | 4 | B | 1.5 | 10.5 | — | 118 | 31 | 39 | 41 | 45 |
| 43 | 8 | 4 | 2 | B | 1.5 | 10.1 | 9.9 | 118 | 30 | 36 | 39 | 41 |
| 44 | 8 | 4 | 4 | B | 1.5 | 10.0 | 9.8 | 118 | 32 | 39 | 42 | 45 |
| 45 | 8 | 4 | 4 | C | 1.5 | 9.9 | 9.5 | 118 | 31 | 38 | 41 | 43 |
| 46 | 8 | 4 | 8 | C | 1.5 | 9.7 | 9.3 | 118 | 31 | 38 | 41 | 44 |

[a]SPB-1 = sodium perborate monohydrate.
[b]Added as $MgSO_4 \cdot 7H_2O$.
[c]Detergent A - Cheer, 0%P (Cheer is a powdered detergent sold by Procter & Gamble Company).
Detergent B - Tide, 6.1%P.
Detergent C - Tide, 12.3%P.

From the above data it can be seen that the inclusion of magnesium in the cyanamide-activated peroxide-based bleach system results in high levels of bleaching being achieved in the presence of various detergents. In addition, the results indicate that enhanced bleaching can be achieved with lower levels of cyanamide activator when magnesium is also present in the system.

EXAMPLE 5

A series of experiments was conducted to determine the effect of commonly employed detergent builders on the bleaching action of the present magnesium-containing, cyanamide-activated, peroxide-based bleach compositions. The test procedure employed was similar to that described in Example 1, except that deionized water with no added hardness or detergent was employed in the Terg-O-Tometer bath. The compositions tested and the resulted obtained are presented in the following table. The temperature of the Terg-O-Tometer bath in all of these tests was 120° F.

TABLE VI

| Experiment No. | $H_2NCN$ mmoles/l | $H_2O_2$ mmoles/l | $MgSO_4$ mmoles/l | Builder Type | Builder mmoles/l | pH Initial | pH Final | ΔR Wash Cycle 10 mins. | ΔR Wash Cycle 20 mins. | ΔR Wash Cycle 30 mins. |
|---|---|---|---|---|---|---|---|---|---|---|
| 47 | 0 | 8 | 0 | None | — | 9.7 | 9.2 | 1.0 | 1.3 | 1.6 |
| 48 | 0 | 8 | 4 | None | — | 9.4 | 8.9 | 0.8 | 1.2 | 1.8 |
| 49 | 8 | 8 | 4 | None | — | 9.5 | 9.3 | 25.8 | 32.2 | 34.9 |
| 50 | 8 | 8 | 4 | STPP[a)] | 2 | 9.6 | 9.4 | 31.7 | 38.7 | 41.2 |
| 51 | 8 | 8 | 4 | TSP[b)] | 3 | 9.3 | 9.0 | 33.6 | 42.6 | 46.4 |
| 52 | 8 | 8 | 4 | $Na_2SIO_3$ | 4 | 9.4 | 9.0 | 35.4 | 42.6 | 45.9 |
| 53 | 8 | 8 | 4 | $Na_2CO_3$ | 4 | 9.5 | 9.4 | 31.2 | 35.7 | 37.9 |
| 54 | 8 | 8 | 4 | $Na_2B_4O_7$ | 4 | 9.3 | 9.2 | 27.4 | 32.5 | 34.3 |

[a)]STPP = Sodium tripolyphosphate
[b)]TSP = Trisodium phosphate

The foregoing test results indicate that hydrogen peroxide alone, or in combination with magnesium sulfate in the absence of cyanamide, exhibits virtually no bleaching activity at 120° F. However, when the magnesium salt and hydrogen peroxide are employed in combination with cyanamide activator, very substantial levels of bleaching activity are obtained, which activity is even further enhanced by the presence of alkali metal phosphates (STPP and TSP), silicates and carbonates, and to a lesser extent borates.

EXAMPLE 6

In this example an encapsulated solid bleaching composition in accordance with the invention was prepared and subjected to a high temperature storage stability test. In this test an encapsulated bleaching composition containing 5.9%w sodium acid cyanamide, 18.6%w sodium perborate monohydrate, 10.6% dimagnesium ethylenediamine tetraacetate and 64.9% sodium sulfate, was placed in an open beaker in an oven at 50° C and the bleaching effectiveness of the composition determined at the outset of the test and at random intervals by removing a portion of the sample from the oven and bleaching a test fabric with it to determine its ΔR potential. The bleach composition was encapsulated by blending 100 parts by weight of the aforementioned ingredients with 12 parts by weight of Neodol ® 25-9 (a $C_{12-15}$ linear, primary alcohol ethoxylate) which had been liquified by heating to facilitate encapsulation. The test results on the encapsulated composition showed that after 4 weeks of continuous storage at 50° C (122° F) the bleaching effectiveness of the composition remained at 84% of its original value.

EXAMPLE 7

A series of experiments was conducted to compare the effect of magnesium relative to other Group IIA metals on the bleaching action of the cyanamide-activated peroxide bleach compositions. The test procedure employed in these experiments was similar to that described in Example I, except that deionized water with no added hardness or detergent was employed in the Terg-O-Tometer bath. The temperature of the Terg-O-Tometer bath in all of these tests was 120° F. The compositions tested and results obtained are presented in the following table.

TABLE VII

| Experiment No. | Activator[a)] mmoles/l | $H_2O_2$[b)] mmoles/l | Metal Ion Type | Metal Ion mmoles/l | pH Initial | pH Final | ΔR Wash Cycle 10 mins. | ΔR Wash Cycle 20 mins. | ΔR Wash Cycle 30 mins. |
|---|---|---|---|---|---|---|---|---|---|
| 55 | 4 | 8 | — | 0 | 10.0 | 10.2 | 5.1 | 7.1 | 8.8 |
| 56 | 4 | 8 | Ca[c)] | 4 | 10.0 | 10.2 | 3.6 | 5.3 | 6.3 |
| 57 | 4 | 8 | Ca[d)] | 4 | 10.0 | 10.1 | 5.4 | 6.8 | 8.3 |
| 58 | 4 | 8 | Ba[e)] | 4 | 9.8 | 10.2 | 4.5 | 6.2 | 7.6 |
| 59 | 4 | 8 | Sr[f)] | 4 | 9.8 | 10.2 | 3.7 | 5.3 | 6.6 |
| 60 | 4 | 8 | — | 0 | 10.0 | 10.2 | 5.1 | 7.0 | 8.7 |
| 61 | 4 | 8 | Mg[g)] | 0.1 | 10.0 | 10.2 | 10.2 | 16.7 | 20.7 |
| 62 | 4 | 8 | Mg[g)] | 0.2 | 10.0 | 10.2 | 17.4 | 28.3 | 33.3 |
| 63 | 4 | 8 | Mg[g)] | 0.4 | 10.0 | 10.1 | 27.2 | 37.3 | 41.0 |
| 64 | 4 | 8 | Mg[g)] | 0.6 | 10.0 | 9.9 | 31.1 | 39.6 | 42.9 |
| 65 | 4 | 8 | Mg[g)] | 2.0 | 10.0 | 9.8 | 32.0 | 39.4 | 41.8 |
| 66 | 4 | 8 | Mg[g)] | 4.0 | 10.0 | 10.0 | 29.8 | 38.1 | 40.9 |

[a)]Sodium acid cyanamide (NaHNCN9
[b)]Added as $NaBO_3 . H_2O$
[c)]Added as $Ca(NO_3)_2 . 4H_2O$
[d)]Added as $Ca(CH_3COO)_2 . H_2O$
[e)]Added as $Ba\ Cl_2 . 2H_2O$
[f)]Added as $SrCl_2 . 6H_2O$
[g)]Added as $MgSO_4 . 7H_2O$ From the foregoing data it is evident that magnesium is unique among the Group IIA metals tested in further enhancing the effectiveness of cyanamide-activated peroxide bleaches, and that even low levels of magnesium, i.e., 0.1 millimole/l, are sufficient to achieve a dramatic "boosting" effect.

It is to be understood that the foregoing detailed description of the invention is merely given by way of illustration, and that many variations may be made without departing from the spirit and scope of the invention.

What is claimed is:

1. A process for activating a peroxide-based bleach which comprises conjointly incorporating into an aqueous medium effective amounts of (a) a peroxide-based bleach, (b) a peroxide-activating amount of cyanamide or a Group IA or Group IIA metal cyanamide, (c) a magnesium compound and (d) a buffering agent to maintain the aqueous medium under alkaline conditions.

2. The process of claim 1 wherein the peroxide-based bleach is hydrogen peroxide, sodium perborate or sodium percarbonate.

3. The process of claim 2 wherein the magnesium compound is a magnesium salt or oxide.

4. The process of claim 3 wherein the peroxide activator is cyanamide or a Group IA or Group IIA metal cyanamide.

5. The process of claim 4 wherein the peroxide-based bleach, metal cyanamide activator or the magnesium salt or oxide also serves as the buffering agent.

6. The process of claim 3 wherein an alkali metal phosphate, carbonate or silicate is additionally incorporated into the aqueous medium.

7. The process of claim 3 wherein the amount of buffering agent is sufficient to maintain the pH of the aqueous medium within the range of 8.5 to 11.5.

8. The process of claim 3 wherein the temperature of the aqueous bleaching medium is from 60° to 160° F.

9. The process of claim 7 wherein the magnesium compound is magnesium hydroxide, magnesium sulfate, magnesium chloride, magnesium nitrate or dimagnesium ethylenediamine tetraacetate.

10. The process of claim 9 wherein the peroxide activator is cyanamide, calcium cyanamide, disodium cyanamide or sodium acid cyanamide.

11. The process of claim 9 wherein the peroxide-based bleach is sodium perborate.

12. A stable concentrated bleaching composition consisting essentially of (a) from 1 to 35% by weight, calculated as hydrogen peroxide, of the total composition of a peroxide-based bleach, (b) a peroxide-activating amount of cyanamide or Group IA or Group IIA metal cyanamide and (c) a magnesium compound, the molar ratio of the magnesium compound to the peroxide-based bleach being from 1:60 to 25:1.

13. The composition of claim 12 wherein the peroxide-based bleach is an aqueous solution of hydrogen peroxide and the peroxide activator is cyanamide, said aqueous solution being buffered to pH of 2 to 5.

14. The composition of claim 13 wherein the molar ratio of cyanamide to hydrogen peroxide is 1:20 to 20:1.

15. The composition of claim 12 wherein the peroxide-based bleach is sodium perborate or sodium percarbonate, and the peroxide activator is cyanamide or a Group IA or Group IIA metal cyanamide.

16. The composition of claim 15 wherein the magnesium compound is a magnesium salt or oxide.

17. The composition of claim 16 wherein the molar ratio of peroxide activator to sodium perborate or sodium percarbonate is 1:20 to 20:1.

18. The composition of claim 17 wherein the peroxide activator is calcium cyanamide, sodium acid cyanamide or disodium cyanamide.

19. The composition of claim 18 additionally containing an alkali metal phosphate, carbonate or silicate.

20. The composition of claim 18 wherein the magnesium compound is magnesium sulfate, magnesium chloride, magnesium nitrate or dimagnesium ethylenediamine tetraacetate.

21. The composition of claim 20 additionally containing sodium tripolyphosphate, trisodium phosphate, sodium carbonate or sodium silicate.

22. The composition of claim 21 wherein the peroxide-based bleach or the peroxide activator is encapsulated.

23. A bleaching/washing composition consisting essentially of an aqueous medium containing (a) from 2 to about 600 millimoles/liter of a peroxide-based bleach, (b) a peroxide-activating amount of cyanamide or Group IA or Group IIA metal cyanamide, (c) a magnesium compound (d) an alkaline buffering agent to maintain the aqueous medium under alkaline conditions and (e) a bleachable substance, the molar ratio of the magnesium compound to the peroxide-based bleach being from 1:60 to 25:1.

24. The composition of claim 23 wherein the magnesium compound is a magnesium salt or oxide.

25. The composition of claim 24 wherein the concentration of peroxide-based bleach in the aqueous medium is from 2 to about 12 millimoles/liter, and the bleachable substance is a fabric.

26. The composition of claim 25 wherein the aqueous medium additionally contains sodium tripolyphosphate, trisodium phosphate, sodium carbonate or sodium silicate.

27. The composition of claim 25 wherein the concentration of magnesium in the aqueous medium is from about 0.1 to about 6 millimoles/liter.

28. In a process for manufacturing a built laundry detergent composition containing a synthetic detergent and an alkaline detergent builder, the improvement which comprises incorporating into said detergent composition (a) from 0.1 to 2% by weight, calculated as hydrogen peroxide, of a peroxide-based bleach, (b) a peroxide-activating amount of cyanamide or Group I or Group IIA metal cyanamide and (c) a magnesium compound, the molar ratio of the magnesium compound to the peroxide-based bleach being from 1:60 to 25:1.

29. A built laundry detergent composition consisting essentially of (a) a major amount of a synthetic detergent and an alkaline detergent builder, (b) a minor amount from 0.1 to 2% by weight, calculated as hydrogen peroxide, of a peroxide-based bleach, (c) a peroxide-activating amount of cyanamide or Group IA or Group IIA metal cyanamide and (d) a magnesium compound, the molar ratio of the magnesium compound to the peroxide-based bleach being from 1:60 to 25:1.

* * * * *